US005499812A

United States Patent [19]

Staka et al.

[11] Patent Number: 5,499,812

[45] Date of Patent: Mar. 19, 1996

[54] CAM ARM APPARATUS FOR TRAINING AND MONITORING DEVICES

[76] Inventors: Robert L. Staka, 136 Las Colinas Dr.; Steven P. Bokariza, 220 Howell La., both of Watsonville, Calif. 95076

[21] Appl. No.: 263,821

[22] Filed: Jun. 22, 1994

[51] Int. Cl.[6] ..... A63B 69/40

[52] U.S. Cl. ..... 273/26 E; 273/29 A; 273/58 C; 273/411

[58] Field of Search ..... 273/413, 411, 273/58 C, 26 R, 29 A, 184 D; 482/87, 83, 88, 91

[56] References Cited

U.S. PATENT DOCUMENTS

| | | | |
|---|---|---|---|
| 2,818,255 | 12/1957 | Ponza | 273/26 R |
| 3,663,018 | 5/1972 | O'Leary | 273/26 R |
| 3,815,922 | 6/1974 | Brainard | 273/184 B |
| 4,023,809 | 5/1977 | Newton | 273/184 B |
| 4,592,545 | 6/1986 | Sagedahl | 482/91 |

*Primary Examiner*—Theatrice Brown
*Attorney, Agent, or Firm*—Jeffrey A. Hall

[57] ABSTRACT

A cam arm apparatus for exercise training and monitoring devices having a base plate secured to a pair of angle plates. A cam is operably secured to the base plate and a cam follower arm which is pivotally linked to a shaft element operably secured to an adjustment knob. An arm element may be secured to the cam for holding and positioning a ball, weight, or other training, sport, or exercise devices. A spindle shaft is linked to the cam and mounted on the angle plates so that the arm element is automatically returned to an initial starting point regardless of the angular positioning of the base plate or the amount of movement of the arm element around the cam, thereby allowing the return of the arm element against gravity to said initial starting point even if the base plate is angularly positioned.

4 Claims, 3 Drawing Sheets

CAM ARM APPARATUS FOR TRAINING AND MONITORING DEVICES

BACKGROUND OF THE INVENTION

1. Field of Invention

This invention relates to exercise and sport apparatuses and systems, and more particularly to cam arm training and monitoring apparatuses for controlling the position of an arm element, ball, weight, or providing resistance training and monitoring for exercise, sport, physical therapy, and the like.

2. Description of Prior Art

With the growing popularity of sport and exercise has come the development of numerous sport training and monitoring apparatuses, exercise training and monitoring apparatuses, and related physical therapy and sports medicine devices. Heretofore, a wide variety of such apparatuses have been proposed and implemented.

A common limitation of all prior exercise and sport training and monitoring devices has been their inability to satisfactorily position and control various parameters of a weight, ball, puck, or arm element holding such weight, ball, or puck, such as height, angle, and tension; nor indicate to the user when a correct hit, stroke, putt, or the like had occurred. Moreover, such prior devices have not provided means for returning the weight, ball, puck, or arm element to an initial starting point, regardless of the angular positioning of the arm element on the device or the amount of movement of the arm. This limitation is significant as prior arm, ball, or weight holding devices could not return the arm or ball or weight against gravity back to an initial starting point when the arm, ball, weight, or the like, was angularly positioned.

A related apparatus invented by the present inventor and disclosed in U.S. Pat. No. 5,238,251 for a volleyball training and monitoring apparatus provided a solution to many of the above limitations for volleyball training and monitoring apparatuses. The present invention is an improvement of this prior invention and is applicable to a wide variety of exercise, sport, weight, and physical training apparatuses.

Accordingly, it is a primary object of this invention to provide an improved cam arm apparatus for use with exercise, sport, weight, and physical training and monitoring apparatus which allows an arm element for holding a ball, weight, puck, or the like to be positioned at any desired angle and tension whereby the arm element is returned to an initial starting point regardless of the angular positioning of the arm or the amount of movement of the arm element resulting from the ball or weight being moved, struck, batted, stroked, or the like, thereby allowing for the return of the arm element against gravity to the initial starting point even if the arm is angularly positioned.

It is a further objective of the invention to provide an exercise and sport training and monitoring apparatus with means to indicate directly to the user whether a correct or an incorrect hit or stroke has been made.

Additional objects and advantages of the invention will be set forth in the description which follows, and in part will be obvious from the description, or may be learned by practice of the invention. The objects and advantages of the invention may be realized and obtained by instrumentalities and combinations particularly pointed out in the appended claims.

SUMMARY OF THE INVENTION

To achieve the foregoing objects, and in accordance with the purposes of the invention as embodied and broadly described herein, a cam arm apparatus for training and monitoring devices is provided, comprising: a base plate secured to a pair of angle plates; means for controlling the position and movement of an arm element comprising a cam operably secured to said base plate; said cam being secured to a cam follower arm pivotally linked to a shaft element operably secured to adjustment means; and a spindle shaft operably linked to said cam and mounted on said pair of angle plates, whereby said arm element is operably secured to said cam so that the arm element is returned to an initial starting point regardless of the angular positioning of said base plate or the amount of movement of the arm element, thereby allowing the return of the arm element against gravity to said initial starting point even if the base plate is angularly positioned.

The means for controlling the position and movement of the arm element preferably includes a compression spring means secured to a cam follower arm having a pivot mounted to a pivot block, said pivot block is secured to a plate means; said compression spring is springably engaged to adjustment knob means, allowing for control and monitoring of the arm element and providing tension and torque control means for said arm element. Positioning means are preferably provided by a positioning plate having angle markings thereon and locking means for securing the positioning plate at a desired angle. Angle indicator means are preferably provided by a positioning disk having a plurality of spaced detents thereon for positioning and alignment corresponding to said angle markings on the positioning plate indicating the desired angle at which the base plate is pivoted for a particular use.

In accordance with the purposes of the invention, there is also provided a cam arm apparatus, for controlling the movement and position of an arm element, comprising: a base, angle plate means secured to said base allowing for adjustment of the angular positioning of said base; means for controlling the position and movement of said arm element, comprising a cam operably secured to said base; said cam being secured to a cam follower arm pivotally lined to a shaft element operably secured to adjustment means; and a spindle shaft operably secured to said cam and mounted on the angle plate means, whereby the arm element is operably secured to said cam so that the arm element is returned to an initial starting point regardless of the angular positioning of said base or the amount of movement of the arm element, thereby allowing for return of the arm against gravity even if the base is angularly positioned.

BRIEF DESCRIPTION OF THE DRAWINGS

The accompanying drawings, which are incorporated in and constitute part of the specification, illustrate a preferred embodiment of the invention and, together with a general description given above and the detailed description given below, serve to explain the principles of the invention.

DETAILED DESCRIPTION OF THE PREFERRED EMBODIMENTS

Reference will now be made in detail to the present preferred embodiments of the invention illustrated in the accompanying drawings.

In accordance with the present invention, there is provided a cam arm apparatus for exercise training and monitoring devices, comprising: a base plate secured to a pair of angle plates; means for controlling the position and movement of an arm element comprising a cam operably secured to said base plate; said cam being secured to a cam follower arm pivotally linked to a shaft element operably secured to adjustment means; and a spindle shaft operably linked to said cam and mounted on said pair of angle plates, whereby said arm element is operably secured to said cam so that the arm element is returned to an initial starting point regardless of the angular positioning of said base plate or the amount of movement of the arm element, thereby allowing the return of the arm element against gravity to said initial starting point even if the base plate is angularly positioned.

Figure 1:
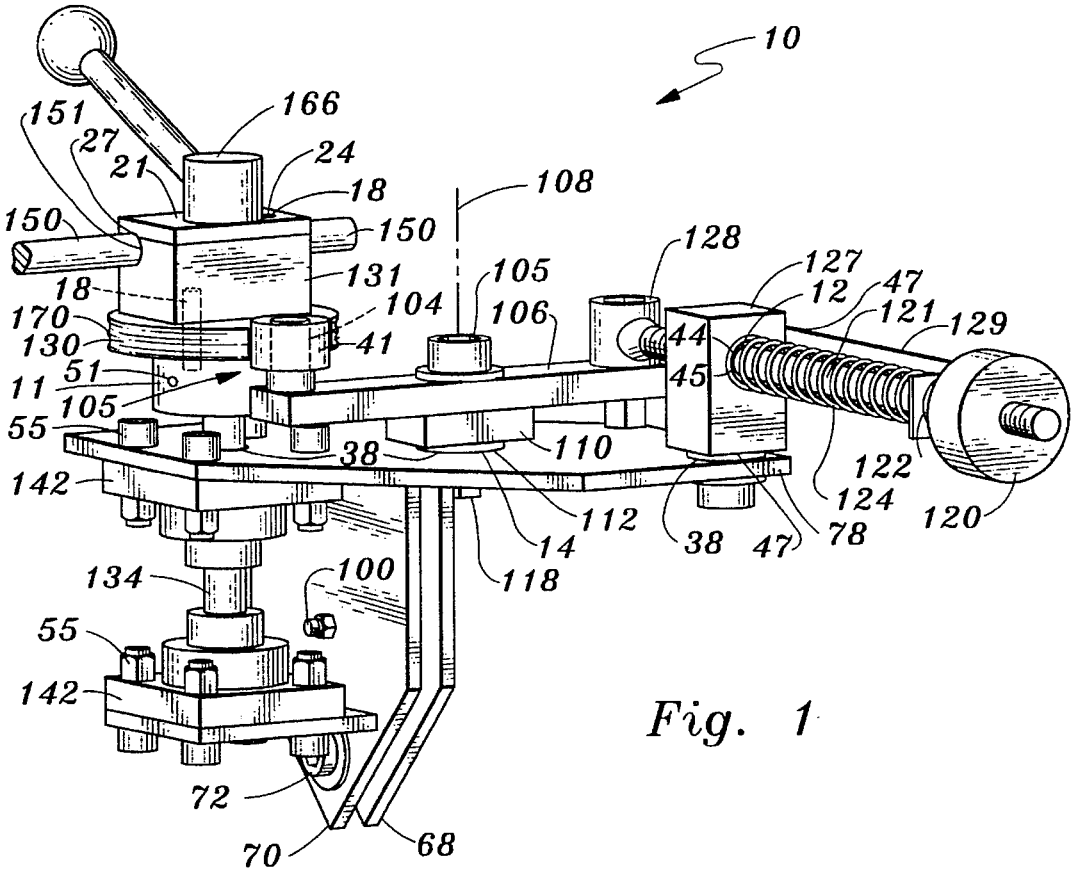
FIG. 1 is a perspective of an embodiment of a cam arm apparatus for training and monitoring devices incorporating the teaching of the present invention.

In FIG. 1, a cam arm apparatus 10 for training and monitoring devices is shown. Cam arm apparatus 10 may be operably mounted on any type of training and monitoring device for exercise, sport, weight training, physical therapy, and the like. For example, cam arm apparatus 10 may be operably mounted on a volleyball training and monitoring apparatus, on a golf training and/or monitoring apparatus, on a soccer training and/or monitoring apparatus, on a weight training apparatus, on a physical therapy type apparatus, or any type of apparatus where the position of an object such as a ball or weight is needed to be held for practice striking, kicking, hitting, stroking, lifting, or the like.

Figure 2:
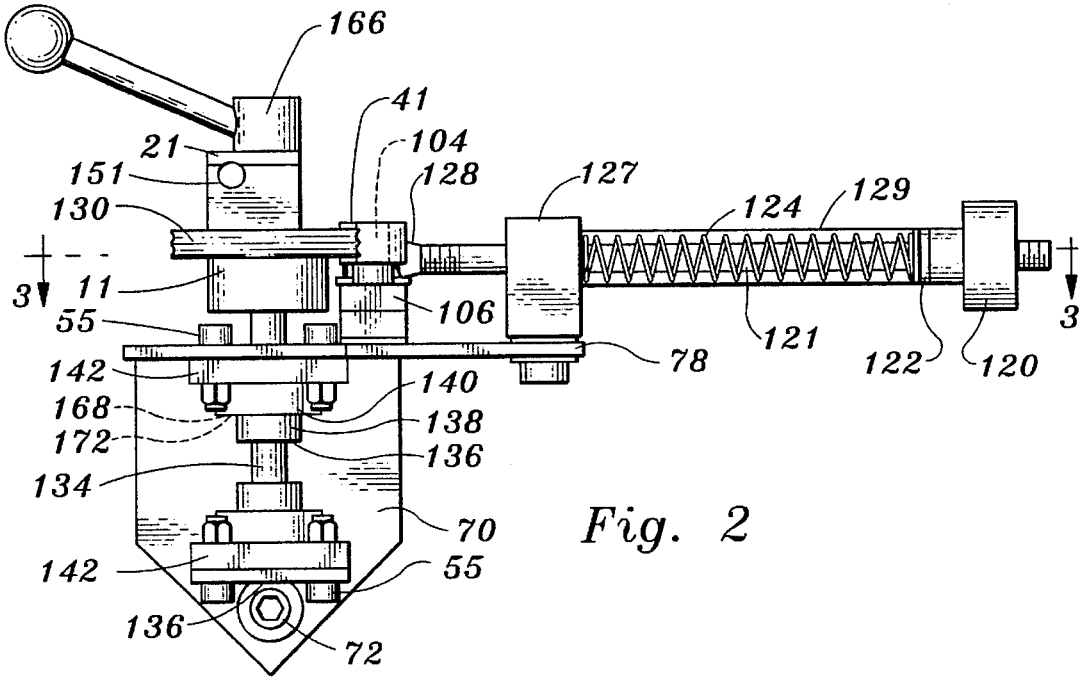
FIG. 2 is a side view of such embodiment, according to the invention.
Figure 3:
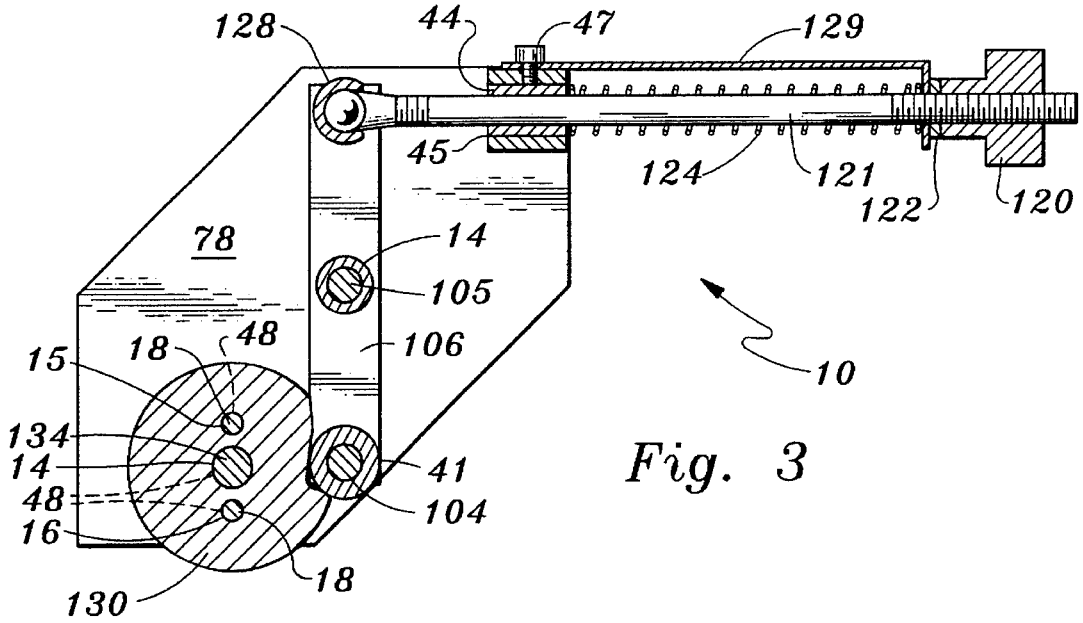
FIG. 3 is a sectional view through 3—3 of such apparatus, according to the invention.
Figure 4:
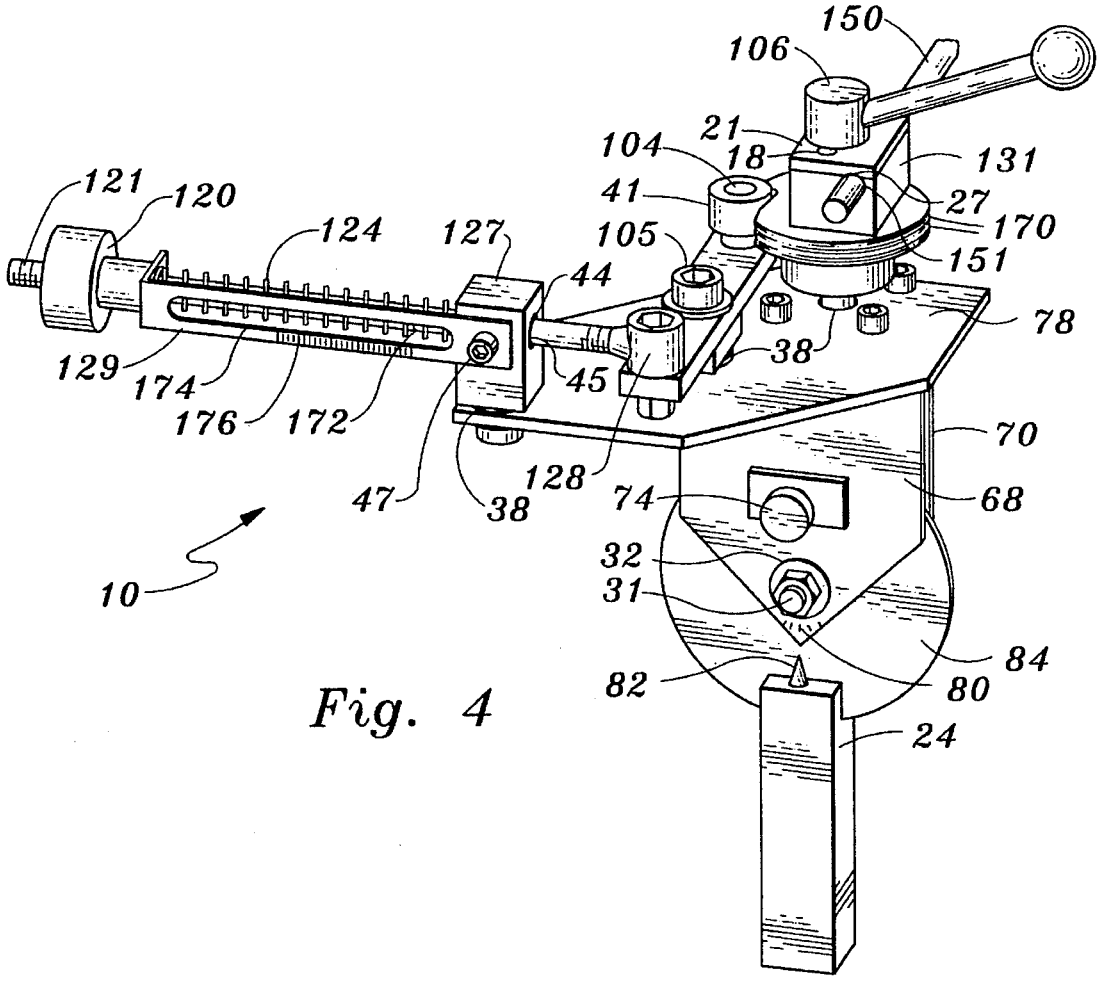
FIG. 4 is a perspective view of such apparatus including an adjustment plate 84, according to the invention.
Figure 5:
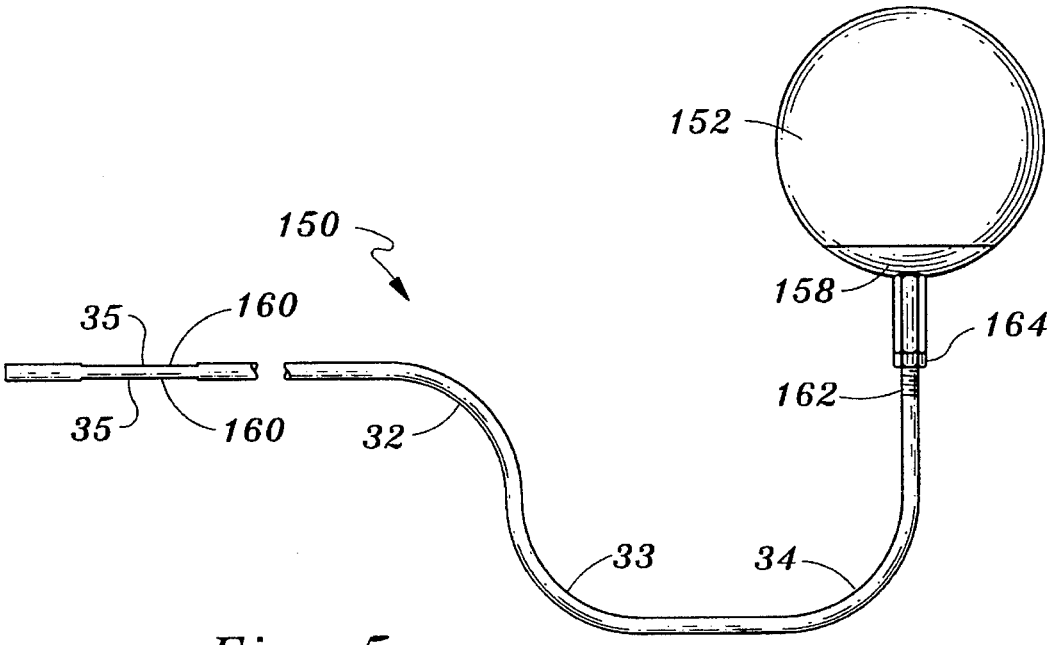
FIG. 5 is an top view of an arm element and ball retaining means of such apparatus, according to the invention.

As shown in FIGS. 1 and 2, and in other views in FIGS. 3, 4, and 5, means for controlling the position and movement of an arm element 150 which may hold a ball 152, or weight, or other device, preferably comprises a cam 130 mounted to cam block 131 and hub 11. Cam block 131 has cap 21 and includes arm element retaining means preferably comprising aperture 151 for holding the arm element and tightening knob 166 on cam block 131 for securing and locking arm element 150 in the cam block. Cam block 131 preferably includes three apertures 23, two for dowel pins 18 and one for shaft 134. A slot or notch 27 is provided on top of cam block 131 to aid in alignment of arm element 150. Cap 21 includes one aperture 24 for for dowel pin 18 to prevent cap 21 from turning when lever clamp 166 is tightened. This configuration allows for quick removal of arm element 150, cap 21, cam block 131, and cam 130 for repositioning the cam and cam block for left handed players or users, for example. A cam follower 104 is preferably secured to cam pivot arm 106 by bolt 105, but may be otherwise, such as screws, rivets, dowels or the like. Cam pivot arm 106 preferably is provided with three apertures 38, for pivotal attachment of plate 78. One of apertures 38 is for a pin 118 for securing the arm to plate 78. Another aperture 38 is for securing a cam follower bearing 41 riding on the face of cam 130, and the third aperture 38 for a rod securing shaft 121 to arm 106. Cam follower 105 is preferably sealed and pre-lubricated for smooth and efficient operation. Pivot 108 is secured to pivot block 110 having threaded aperture 112 and secured thereto by bolt 118 and bushing 14. Pivot block 110 is preferably welded to cam support plate 78, however, other fastening means may also be utilized such as bolts, screws, rivets, and the like. Cam follower arm is pivotally secured to shaft 121 and extends through block 127 preferably including linear bearings 12 and with bar 129 extending from the block, best seen in FIGS. 1 and 3. Shaft 121 is preferably threaded on both ends with one end threaded to adjustment knob 120 and the other end to rod 128. Linear bearing block 127 includes linear bearing 44 to provide smooth motion for shaft 121 as pivot arm 106 pivots. Shaft 121 moves back and forth with the movement of arm 106. Block 127 includes an aperture 45 for linear bearing 44 and two threaded holes 47 for retaining pins, screws, bolts, or the like, for mounting block 127 on plate 78. Preferably a shoulder screw is used in combination with a thrust washer allowing for bar 129 retaining shaft 121 as shaft 121 moves back and forth. Gauge 172 preferably including slot 144 and adjustment marks 176 may be provided on block 127 below aperture 47 allowing for tension adjustments as desired as plate 78 is pivoted at a desired angle. Bar 129 is provided with two apertures 49 which slide over shaft 121. Preferably a shoulder screw and washer are provided to secure bar 121 and to minimize friction. Spring 124 is positioned around shaft 121 and is positioned against block 127. Spring 124 provides tension as bar 121 moves within spring 124 and against adjusting knob 120. Adjustment means are preferably provided adjustment knob 120 providing means for adjusting tension, depending on the angle plate 78 is positioned. Washer 122 and tension spring 124 are operably secured to shaft 124, providing tension adjustment means for cam arm apparatus 10. A pivot pin 128, or bolt, screw rivet, or the like may be used to secure cam follower arm 106 to shaft 121.

Cam 130 is provided, in the preferred embodiment, with three apertures 14, 15, and 16 and with multiple radiuses 170. Aperture 14 secures spindle shaft 134 while apertures 14 and 15 secure dowel pins 18. Cam 130 may be alternatively positioned, for example at 180 degrees to that shown and described, for left handed users. Cam 130 is positioned and mounted over dowel pins 18 and spindle shaft 134 so that arm element 150 when rotated from a starting point, regardless of the whether it goes part or all of the way about cam 130, and regardless of the angle at which plate 78 is positioned, returns to its starting point assisted by spring tension and multiple radiuses 170 on cam 130. Arm element 150 will return to its starting point or position in cam block 131 when moved from that starting position. This is true regardless of the angle that plate 78 is positioned at, for example, 45 degrees, 30 degrees, 15 degrees or the like. Therefore, it does not matter where arm element 150 stops after being moved, struck, hit, or the like, arm 150 continues around cam 130 to its initial starting point because of spindle shaft 134, dowel pins 18, and shaft 121. Significantly, arm element 150 is returned to its starting point even against gravity by cam 130 and spindle shaft 134, providing a great variety of applications in exercise and sport training and monitoring device, and in physical therapy type apparatuses.

A seen in FIGS. 1, 2, and 4, spindle shaft 134 preferably passes through two bearings 142. Hub 11 is preferably secured to shaft 134 by a key and set screw 51, but other fastening means well known in the art such as screws, pins, bolts or the like may be used. Cam 130 is positioned above hub 11 having dowel pins 18, preferably two such pins, operably secured therein. Cap 21 on cam 130 is provided so that arm element 150 is sandwiched with between cap 21 and cam 130 by clamp lever 166 which is preferably threaded. Shaft 134 is preferably threaded at its upper end and has key means mid-way from the upper end, that is, the end secured to cam hub 11. Hub 11 preferably has three apertures 48 and corresponding screws to screw and secure dowel pins 18 therein, and to secure hub 11 to shaft 134. Dowel pins 18 are positioned to align the cam to to block each other. In other words, dowel pins 18 allow cam 130 to be turned over 180 degrees for left handed users, or rotated back 180 degrees for right handed users, or rotated 360 degrees when the object or ball held on arm element 150 is struck or rotated with sufficient force.

Figure 6:
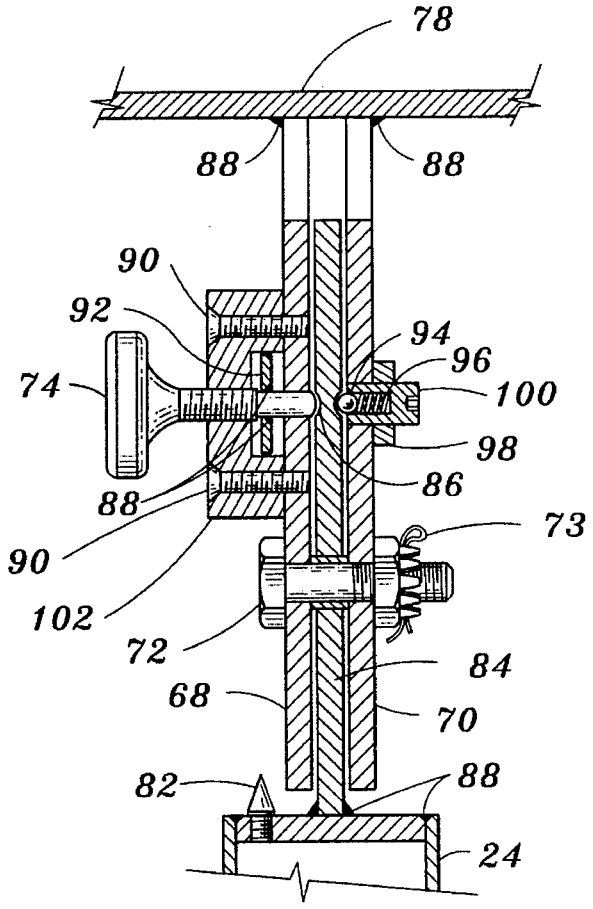
FIG. 6 is an exploded sectional view of an angle adjustment means, according to the invention.

As shown in FIGS. 4 and 6, a locating disk 84 may be provided for angle adjustment means for adjusting the angle at which a ball 152 is positioned and comprises, in this embodiment, locating disk 84 operably secured to plate 78 and angle plates 68 and 70 secured together with bolt 100. Preferably locating disk 84 is operably secured to plate 78 by a shoulder screw 31 and washer 32, however, pins, bolts, and other conventional fastening means may also be used, so that plate 78 can pivot on shoulder screw 31 on disk 84 and be locked in a desired angle by spring plunger 74. Pointer 82 on member 24 indicates angles designated on angle markings 80 on angle plate 68, thereby providing positioning means for apparatus 10. Locating disk 84 is preferably secured to angle plates 68 and 70 and to a backing plate 70 by bolt 72 and cotter pin 73, but may be otherwise. Threaded knob 74 locks into detents 86 for positioning ball 152 at a desired angle, and is secured to the positioning plate by block 102, screws 90, washer 92, and welds 88, so as to secure knob 74 in position when adjusting the angle of positioning plate 68. However, other conventional fastening means such as bolts, adhesives, rivets, or the like may alternatively be used. Angle plate 68 and 70 are secured to cam support base plate 78 by welds 88, however, bolts, screws, adhesives, or other fastening means maybe substituted therefore.

Arm element 150 is preferably composed of spring steel or fiberglass, however, other durable resilient material may be used. Arm 150 is preferably bent at 90 degree angles in three locations 32, 33, 34, and two flat surface areas 35 positioned 180 degrees from one another are provided, as shown in FIG. 5. Flat areas 35 aid in securing the arm in position. Arm element 150 can be rotated 180 degrees for left handed users or back 180 degrees for right handed users. Arm element 150 in this configuration is configured to wobble when a ball held on arm element 150 is hit incorrectly. Bends 32, 33, and 34 are useful to provide a balance weight to counteract gravitational forces. Cam 130 secured on plate 78 and operably coupled cam follower arm 106 and arm element 150 provides both positioning and control means for ball 152, weights, or the like, and is secured to arm element 150. Best seen in FIGS. 2 and 5, is the linkage of ball support arm 150 cam 130, support plate 78, and slots 160 in arm 150. The positioning and support means provided by cam 130, cam follower arm 106, and arm element 150, are preferably adjusted so that when a user moves arm 150, by for example, striking ball 152 in a correct fashion, arm 150 rotates about spindle 134 smoothly, while an incorrect hit produces an attenuated, wobbly movement of arm 150, immediately indicating to the user that the ball has been incorrectly hit. For example, when cam arm apparatus is used for a sport such as soccer or volleyball, what is a correct kick or hit is determined by the settings of positioning plate 68, locating disk 84 and the setting of arm 150 in cam 130, and of course, may be varied to correspond to the purpose and training requirements of the user. To accomplish this, arm 150 is secured in cam 130 by knob 166 which is preferably engaged in slots 160 in arm 150 as shown in 1–4. Slots 160 and knob 166 function to keep arm parallel to base plate 78 so a correct hit will impact perpendicular to plate 78 resulting in a smooth rotation of the cam. Spindle 134 is secured to plate 78 by plug 132 which is preferably welded thereto, however, other conventional fastening means may be used as well, such as bolts, screws, rivets, and the like. Seal 136 is secured to inner race 138 and spindle bearings 142 are preferably secured to spindle 134 and to outer race 140. Spindle 134 is preferably secured by nut 146 with cotter pin 148 to pre-load bearings 142. Support bushing 168 is shown secured by nut 172, and with knob 166 tightening and securing arm 150 in a parallel orientation to base plate 78 allowing rotation of arm 150 as a result of striking ball 152 or otherwise moving arm 150 parallel to base plate 78, which is angularly adjusted by positioning plate 68 and locating disk 84.

Referring now to FIG. 5, preferred means for supporting and positioning an object on arm element 150 such as ball 152, preferably comprise arm 150 with slots 160 for coupling with cam 130, and ball retaining pad 158 for securing and positioning ball 152 on arm 150. Ball retaining pad 158 may be used with volleyballs, soccer balls, golf balls, and the like. Such balls are preferably glued with adhesives to retaining pad 158, however, they may be otherwise secured. In the preferred embodiment, arm 150 is threaded with threads 162 to attach locking nut 164 for securing and positioning ball retaining pad 158. Retaining pad 158 is preferably composed of a durable, flexible material such as rubber or thermoplastics. In FIG. 5, ball retaining pad 158 is configured to hold a volleyball therein, however, if apparatus 10 is used for other sports, with a differently configured game ball, alternative configurations of pad 158 would be used. Slots 160 are preferably flat and positioned 180 degrees from each other for rotating arm 150 of apparatus 10 for use by either left or right handed players.

In operation and use cam arm apparatus 10 for training and monitoring devices is extremely efficient for use with any sport, exercise, or therapeutic equipment, where a resistance arm is needed and to which a ball, weight, or other object may be secured. Moreover, the concept embraced by the present invention and illustrated in the embodiments described is applicable to sports as including volleyball, tennis, soccer, water polo or other ball oriented sports with appropriate modifications of apparatus 10. Apparatus 10 is also very useful in physical or medical therapy type applications where arm element 150 may be used to train, monitor, exercise, and other therapeutic applications. For example, a ball, such as volleyball 152, is placed in retaining pad 158 on arm 150. The angle at which the user desires to set ball 152 and arm 150 is set by means of knob 74 securing positioning plate 68 and locating disk 84 at a desired angle utilizing angle indicator markings 80 and pointer 82. The angle of plate 78 is thereby altered which in turn determines the angularity of arm 150 and cam 130. The tension at which arm 150 is held is adjusted by knob 120 to accommodate players of varying strengths and abilities. Cam 130 is designed so that arm 150 is returned to its initial starting point regardless of how far around cam 130 the arm is rotated, or at what angle plate 78 is positioned, allowing the return of arm 150 to its starting point even against gravity, that is when plate 78 is angularly positioned.

While the above description contains many specificities, they should not be construed as limitations on the scope of the invention, but merely as exemplifications of preferred embodiments thereof. Additional advantages and modifications will readily occur to those skilled in the art. The invention in its broader aspects is, therefore, not limited to the specific details, representative apparatus and illustrative examples shown and described. Accordingly, departures may be made from such details without departing from the spirit or scope of the applicant's general inventive concept.

What is claimed is:

1. A cam arm apparatus for exercise training and monitoring devices, comprising:

a base plate secured to a pair of angle plates;

means for controlling the position and movement of an arm element comprising a cam operably secured to said base plate; said cam being secured to a cam follower arm pivotally linked to a shaft element operably secured to adjustment means; and a spindle shaft operably linked to said cam and mounted on said pair of angle plates, whereby said arm element is operably secured to said cam so that the arm element is returned to an initial starting point regardless of the angular positioning of said base plate or the amount of movement of the arm element, thereby allowing the return of the arm element against gravity to said initial starting point even if the base plate is angularly positioned.

2. The cam arm apparatus of claim 1, wherein said adjustment means include an adjustment knob operably secured to said shaft element.

3. The cam arm apparatus of claim 1, wherein said arm element comprises a flexible arm including ball retaining means comprising a flexible pad retainer.

4. A cam arm apparatus, for controlling the movement and position of an arm element, comprising:

a base;

angle plate means secured to said base allowing for adjustment of the angular positioning of said base;

means for controlling the position and movement of said arm element, comprising a cam operably secured to said base; said cam being secured to a cam follower arm pivotally linked to a shaft element operably secured to adjustment means; and a spindle shaft operably secured to said cam and mounted on the angle plate means, whereby the arm element is operably secured to said cam so that the arm element is returned to an initial starting point regardless of the angular positioning of said base or the amount of movement of the arm element, thereby allowing the return of the arm against gravity even if the base is angularly positioned.

* * * * *